US005097569A

United States Patent [19]

Erickson

[11] Patent Number: 5,097,569

[45] Date of Patent: Mar. 24, 1992

[54] TIE BACK TACK

[76] Inventor: Ronald A. Erickson, 8434 Yates Ave. North, Brooklyn Park, Minn. 55443

[21] Appl. No.: 540,223

[22] Filed: Jun. 19, 1990

[51] Int. Cl.[5] ..... A41D 25/10

[52] U.S. Cl. ..... 24/49 R; 24/49 CF; 24/49 CP

[58] Field of Search ..... 24/49 R, 49 CF, 49 CC, 24/49 CP, 49 K, 49 M, 49 TS, 49 A

[56] References Cited

U.S. PATENT DOCUMENTS

| | | | |
|---|---|---|---|
| 1,109,283 | 9/1914 | Elmore | 24/49 CP |
| 1,692,043 | 11/1928 | Kremski et al. | 24/49 M |
| 1,726,185 | 8/1929 | Kremski et al. | 24/49 TS |
| 1,764,705 | 6/1930 | Ward . | |
| 2,016,747 | 10/1935 | Kaplan et al. | 24/49 CP |
| 2,024,943 | 12/1935 | Mix | 24/49 |
| 2,500,114 | 3/1950 | Bowder | 24/49 CP |
| 2,586,215 | 2/1952 | Federico | 24/49 |
| 2,621,386 | 12/1952 | Bowder | 24/155 |
| 2,948,936 | 8/1960 | Winthrop | 24/49 |
| 3,116,525 | 1/1964 | Koby | 24/49 |
| 3,173,181 | 3/1965 | Marien | 24/49 |
| 3,319,304 | 5/1967 | Adams | 24/49 TS |
| 3,357,063 | 12/1967 | Eiben | 24/49 |
| 3,499,192 | 3/1970 | Holtz | 24/49 |
| 3,508,041 | 4/1970 | Sweany et al. | 240/6.4 |
| 3,802,032 | 4/1974 | Weed | 24/49 |
| 3,968,544 | 7/1976 | Sinclair | 24/49 |
| 4,123,824 | 11/1978 | Roberts | 24/49 |
| 4,126,917 | 11/1978 | Nakatsuji | 24/85 R |
| 4,184,231 | 1/1980 | Konnan | 24/49 R |
| 4,554,710 | 11/1985 | Grant | 24/49 CF |
| 4,686,716 | 8/1987 | Burns | 2/152 R |
| 4,835,821 | 6/1989 | Durante | 24/49 CF |

*Primary Examiner*—Victor N. Sakran
*Attorney, Agent, or Firm*—Kinney & Lange

[57] ABSTRACT

The tie back tack is used to secure a four-in-hand necktie to a shirt with minimal lateral movement of the necktie and without puncturing the front pendant of the necktie. A four link chain extends from the tie back tack and is attached to a removable clasp. The removable clasp attaches to the front edge of the shirt and keeps the necktie not only in place but centered at all times.

4 Claims, 2 Drawing Sheets

TIE BACK TACK

BACKGROUND OF THE INVENTION

This invention relates to a removable device for securing a four-in-hand necktie to a shirt without piercing a front pendant of a necktie. Since the necktie is becoming a more important part of a man's wardrobe, men are spending more for their neckties. As a result, they do not want to damage the necktie.

All of the prior art devices suffer from the disadvantages of being either inconvenient to use and remove, put holes in the front pendant of the necktie, or give either too much or too little lateral necktie movement of the necktie relative to the shirt due to long weak attachments. The chains average 42 mm in length and are 0.4 mm thick. Furthermore, some of the prior art devices are designed to be permanently secured to the necktie itself, thereby precluding their use with other neckties. And finally, many men do not like the appearance of tie tacks, tie clasps, tie bars, tie chains and tie holders on the outward side of the front pendant of the four-in-hand necktie.

U.S. Pat. No. 3,357,063 issued to Eiben Dec. 12, 1967 and U.S. Pat. No. 2,586,215 issued to Federico Feb. 19, 1952 characterize deficiencies found in the prior art. Eiben shows a tie tack having an ornamental member on a pin. The pin passes through both front and rear pendants of the necktie and is connected to a long connecting chain. The chain attaches with a bar to a button hole on a wearer's shirt. Federico shows a tie holder comprising a pair of clips that are attached to opposite edges of a necktie's front pendant. The clips are interconnected with a chain that is also coupled to a clasp. The clasp attaches to a wearer's shirt.

SUMMARY OF THE INVENTION

It is the object of this invention to provide a tie tack that attaches the pendants of a necktie to the shirt without being seen.

Another object is to be able to attach the tie back tack to the front edge of the shirt at any level that the necktie holding loop, on the back of the front pendant, happens to be at after the wearer ties the necktie.

It is another object to provide a process using the tie tack that does not put a hole in a different place on the front pendant each time the wearer puts on the necktie, thereby preventing damage to the necktie.

Another advantage of this invention is to keep the tie centered vertically at all times allowing only necessary vertical and horizontal movement of the necktie relative to the shirt.

All parts necessary to manufacture the tie back tack are available in today's marketplace at reasonable prices.

BRIEF OF THE DRAWINGS

DETAILED DESCRIPTION OF THE PREFERRED EMBODIMENTS

Figure 1:
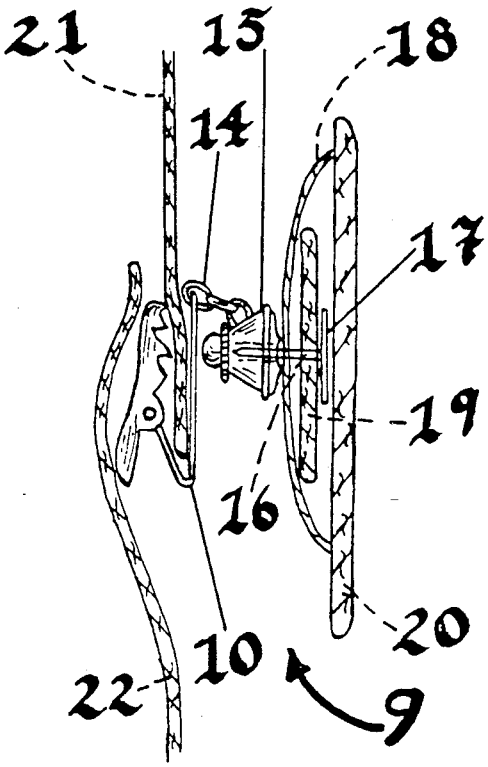
FIG. 1 is a top cross sectional view of the tie back tack.

FIG. 1 is a top cross sectional view through a necktie with the tie back tack or necktie holder 9 in place on a shirt 22. The necktie holder 9 comprises an outermember 17, a pin 16, a retainer 15, a four link chain 14 and a clasp 10. Pin 16 is placed midway through the rear hanging pendant 19 and the manufacturer's label or rear pendant holding loop 18 that is attached to a rear surface of a front pendant 20. Pin 16 is then inserted into the retainer 15. The chain 14 connects retainer 15 to the shirt clasp 10.

Figure 2:
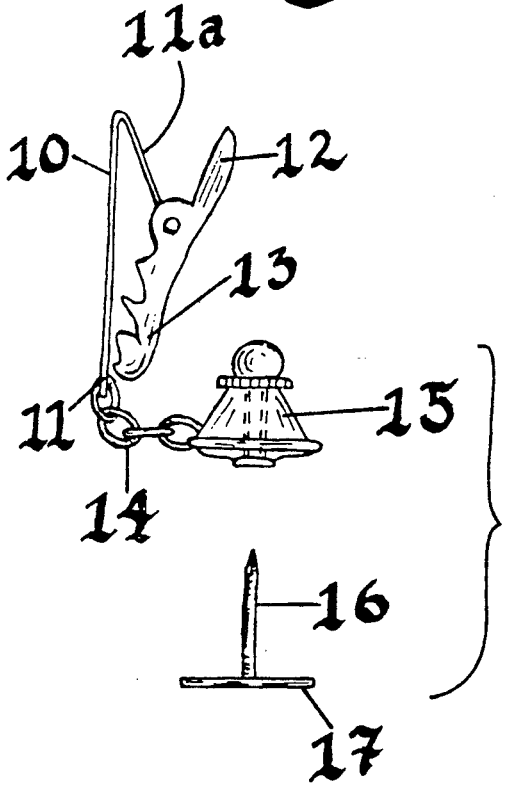
FIG. 2 is a side view of the tie back tack with parts shown in exploded relation.

FIG. 2 shows a side view of the necktie holder 9. The outer member 17 is a circular disk with an attached pin 16 which pierces only the rear pendant 19 and the rear pendant holder loop 18, and holds the rear pendant 19 and the rear pendant holding loop 18 together when the pin 16 is inserted into the retainer 15. The four-link chain 14 connects the retainer 15 with the shirt-engaging clasp 10. The clasp 10 comprises a clasping bar 11 and a riveted end **11*a* that is bent around the back side of the front edge of the shirt. Attached to the riveted end 11*a* is a spring actuated clasping lever 12 that has serrated inner flanged edges 13**.

Figure 3:
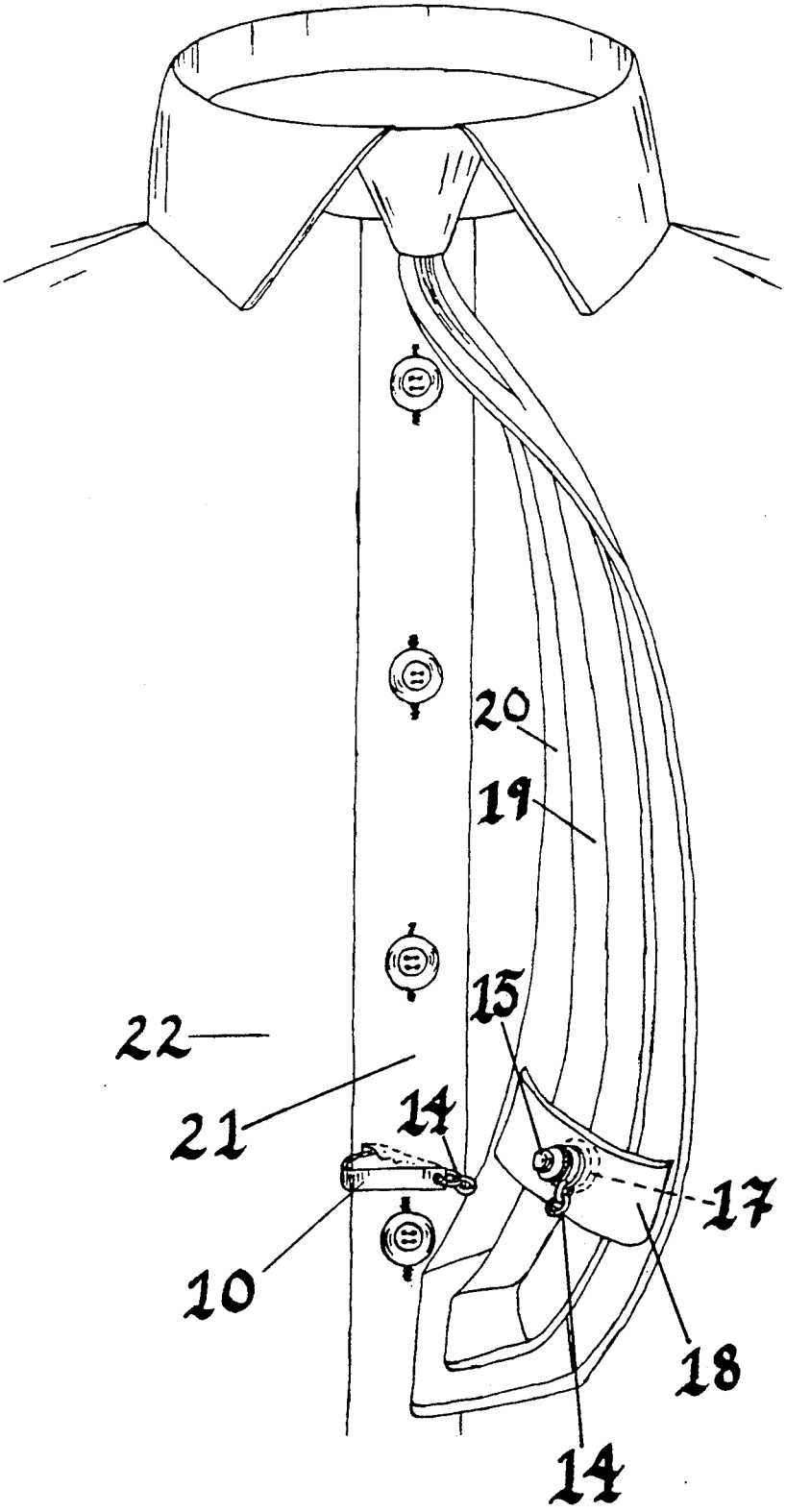
FIG. 3 is a front view of the tie back tack in use, chain detached.

FIG. 3 shows a necktie with the narrower rear pendant 19 placed behind the front pendant 20 and through the rear pendant holding loop 18. The four-link chain 14 is detached to show the necktie holder 9 in place. The necktie holder 9 is fastened to the necktie by placing the outer member 17 between the front pendant 20 and rear pendant 19. The pin 16 is placed in front of the rear pendant 19 and pierces both the rear pendant 19 and the rear pendant holding loop 18. The retainer 15 is then attached to the pin 16. The complete assembly is then attached to the front edge of shirt 21 by the use of a short four-link chain 14, which allows the necktie 20 to move slightly, and a spring actuated clasp 10. Individual links of the four-link chain 14 are approximately 0.85 mm thick, while total length of the four-link chain 14 is approximately 3.9 mm. The necktie holder 9 thus holds the tie pendants 19 and 20 in place anywhere along the front edge of shirt 21 and does not have to be limited to location of button holes.

Although the present invention has been described with reference to preferred embodiments, workers skilled in the art will recognize that changes may be made in form and detail without departing from the spirit and scope of the invention.

What is claimed is:

1. A necktie holder for positioning and securing a necktie in front of a shirt, the necktie comprising an outwardly facing front pendant and a narrower rear pendant positioned behind the front pendant with a rear pendant holding loop attached to a rear side of the front pendant, the necktie holder comprising:

an outer member, positioned between the front pendant and the rear pendant and fastened to a pin, wherein the pin engages only the rear pendant and the rear pendant holding loop by piercing and extending rearwardly through the rear pendant and the rear pendant holding loop; and a short chain with a retainer receiving the pin attached at one end and means for securing the necktie holder to the shirt attached at an opposite end.

2. The necktie holder according to claim 1, wherein the means for securing the necktie holder to the shirt is a spring actuated clasp with serrated inner edges.

3. The necktie holder according to claim 2, wherein the short chain comprises four links.

4. The necktie holder according to claim 2, wherein the rear pendant is positioned within the rear pendant holding loop.

* * * * *